US005685140A

United States Patent [19]

Clements et al.

[11] Patent Number: 5,685,140

[45] Date of Patent: Nov. 11, 1997

[54] METHOD FOR DISTRIBUTING FUEL WITHIN AN AUGMENTOR

[75] Inventors: Thomas R. Clements, Palm City; Derk S. Philippona, Palm Beach Gardens, both of Fla.

[73] Assignee: United Technologies Corporation, Hartford, Conn.

[21] Appl. No.: 493,030

[22] Filed: Jun. 21, 1995

[51] Int. Cl.[6] ..... B63H 11/00

[52] U.S. Cl. ..... 60/204; 60/39.06; 60/261

[58] Field of Search ..... 60/39.06, 204, 60/261, 262, 734, 738, 749

[56] References Cited

U.S. PATENT DOCUMENTS

| | | | |
|---|---|---|---|
| 4,280,324 | 7/1981 | Arliguie et al. | 60/261 |
| 4,398,388 | 8/1983 | Langston, Jr. | 60/241 |
| 4,720,971 | 1/1988 | DuBell | 60/204 |
| 4,751,815 | 6/1988 | Moore | 60/261 |
| 4,765,136 | 8/1988 | Clements et al. | 60/261 |
| 4,833,881 | 5/1989 | Vdoviak et al. | 60/261 |
| 4,887,425 | 12/1989 | Vdoviak | 60/261 |
| 4,989,407 | 2/1991 | Grant, Jr. | 60/261 |
| 5,001,898 | 3/1991 | Holladay | 60/261 |
| 5,117,628 | 6/1992 | Koshoffer | 60/226.1 |
| 5,367,874 | 11/1994 | Auffret et al. | 60/261 |
| 5,385,015 | 1/1995 | Clements et al. | 60/261 |
| 5,400,589 | 3/1995 | Mahias et al. | 60/261 |

FOREIGN PATENT DOCUMENTS

| | | | |
|---|---|---|---|
| 1139005 | 1/1969 | United Kingdom | 60/261 |

*Primary Examiner*—Charles G. Freay
*Attorney, Agent, or Firm*—Richard D. Getz

[57] ABSTRACT

A method for distributing fuel within a gas turbine engine is provided. An augmentor is provided which includes a plurality of vanes. Each vane includes a pair of side walls, an aft wall, and a plurality of fuel apertures and pressurized gas apertures extending through the side walls. At least one of the pressurized gas apertures is positioned adjacent and forward of all fuel apertures at a particular position. At least one fuel distributor is provided in each vane. Fuel admitted into the fuel distributors flows into the core gas path in a direction substantially perpendicular to the core gas path. Gas admitted into the vanes at a pressure higher than that of the core gas flow, flows a distance into the core gas path in a direction substantially perpendicular to the core gas path. Fuel is selectively admitted into the fuel distributors when the augmentor is enabled. Pressurized gas entering the core gas path forward of the fuel creates a low velocity wake that enables the fuel to distribute circumferentially.

16 Claims, 2 Drawing Sheets

FIG. 1
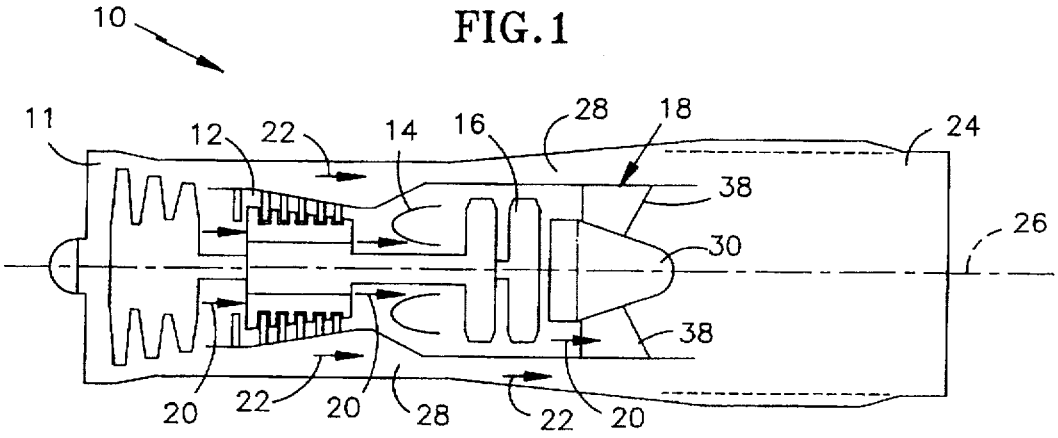
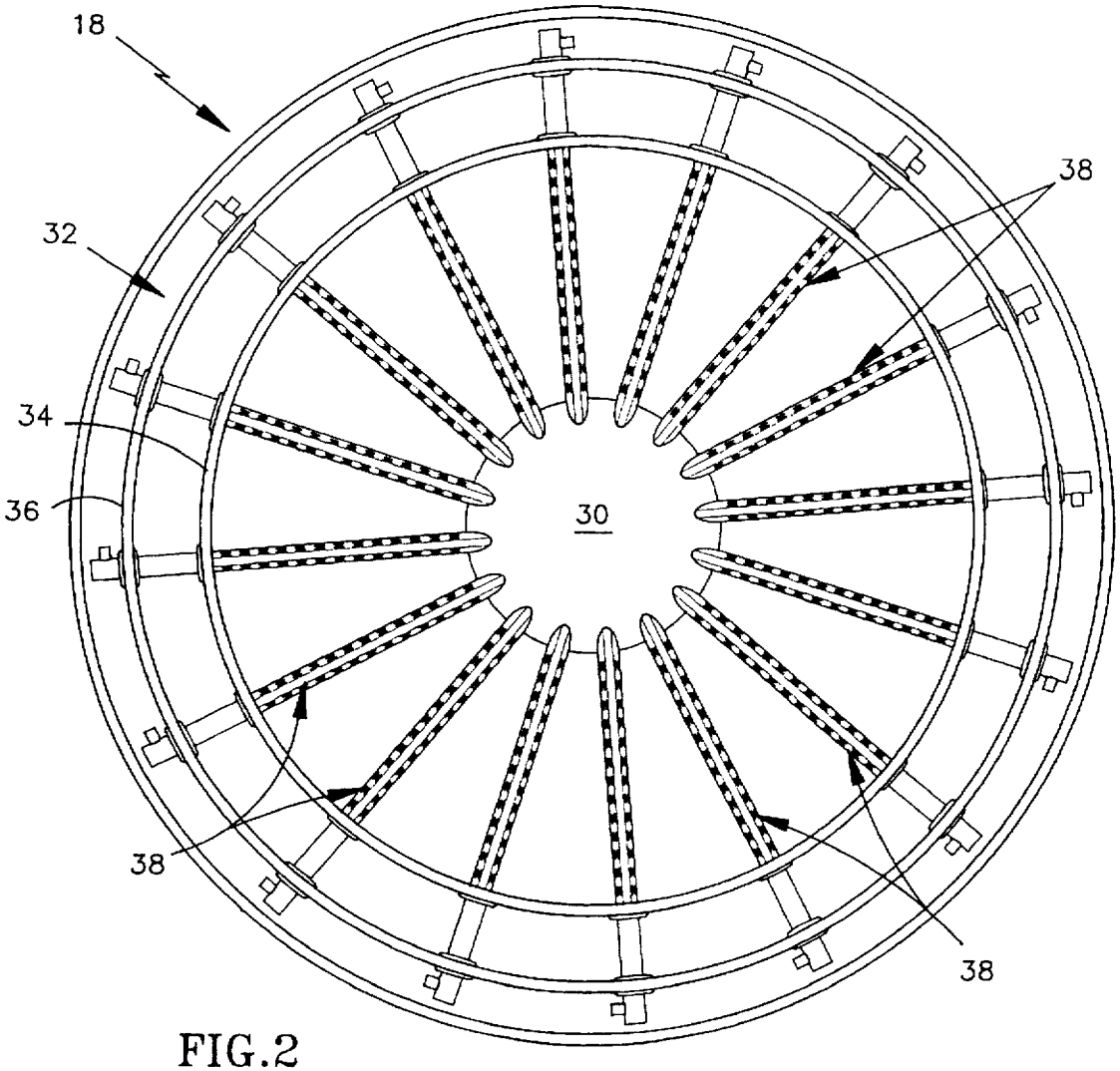
FIG. 2

FIG.3
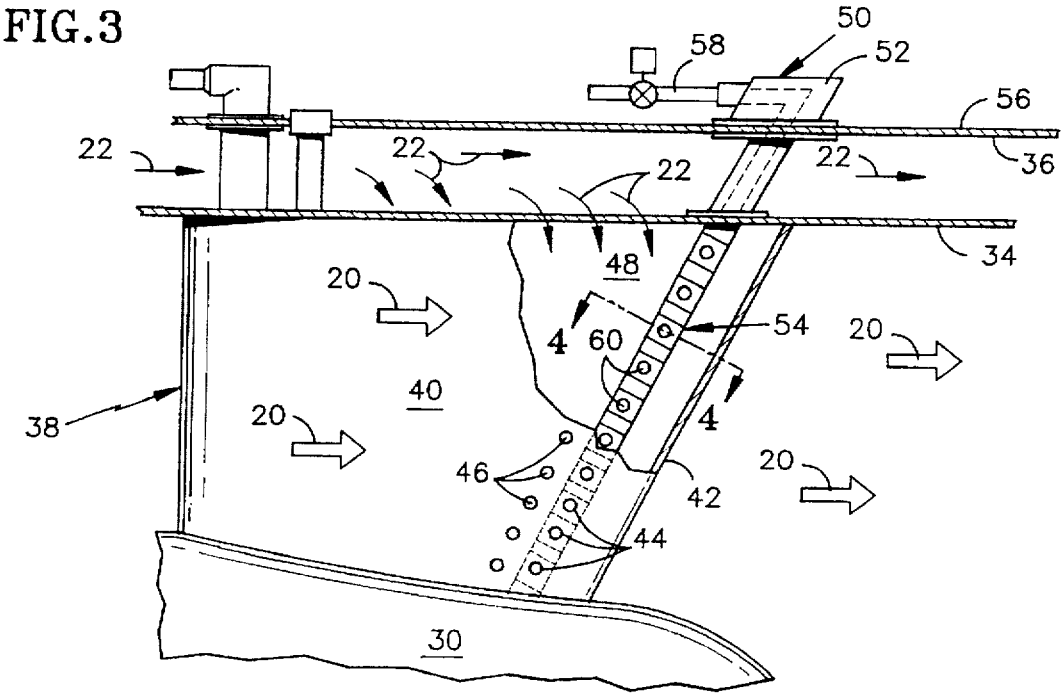
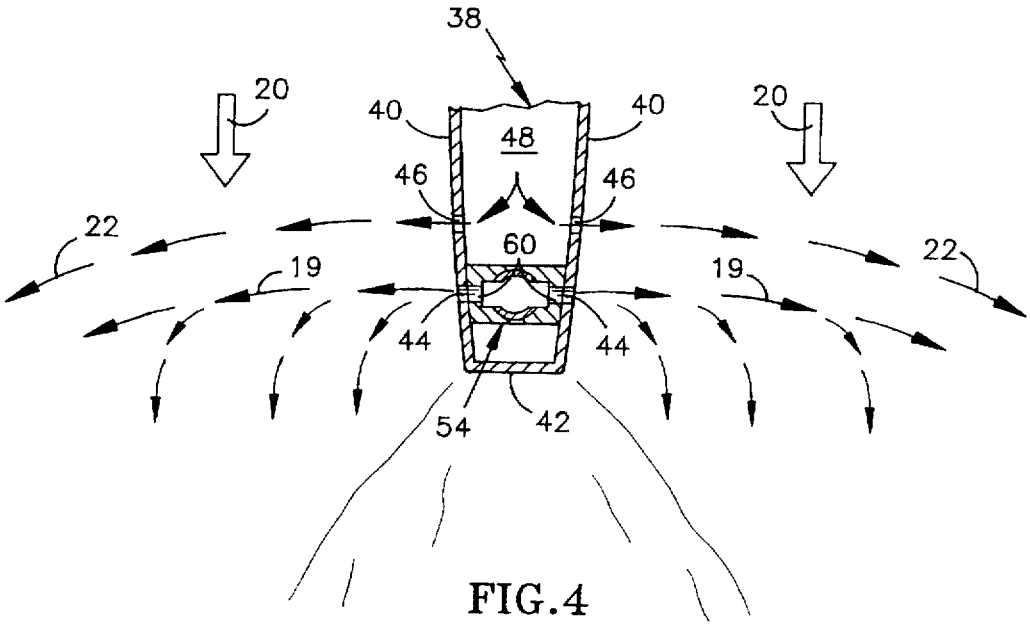
FIG.4

METHOD FOR DISTRIBUTING FUEL WITHIN AN AUGMENTOR

The invention was made under a U.S. Government contract and the Government has rights herein.

BACKGROUND OF THE INVENTION

1. Technical Field

This invention relates to augmentors for gas turbine engines in general, and more specifically to methods and apparatus for distributing fuel within an augmentor.

2. Background Information

Augmentors, or "afterburners", are a known means for increasing the thrust of a gas turbine engine. Additional thrust is produced within an augmentor when oxygen contained within the core gas flow of the engine is mixed with fuel and burned. In some instances, additional thrust is produced by mixing and burning fuel with cooling, or bypass, air entering the augmentor through the inner liner of the augmentor shell as well. Providing successful methods and apparatus for mixing fuel with all the available oxygen continues to be a problem for engine designers, however, due to the harsh environment in the augmentor.

In early augmentor designs, fuel spray rings and flame holders were positioned directly in the core gas path to deliver the fuel in a circumferentially distributed manner and to maintain the flame once ignited. An advantage of the fuel spray rings is that it is possible to evenly distribute fuel about the circumference of the augmentor at any particular radial position. Different diameter spray rings distribute fuel to different radial positions within the augmentor. Mechanical flame holders were provided that acted as an aerodynamic bluff body, creating a low velocity wake within an area downstream. The fuel spray ring and mechanical flame holder designs were acceptable because the core gas flow temperature was within the acceptable range of the spray ring and flame holder materials. Modern gas turbine engines, however, operate at temperatures which make positioning spray rings and flame holders in the core gas path neither practical nor desirable. In addition, spray rings and flame holders present flow impediments to the core gas flow and therefore negatively affect the performance of the engine.

U.S. Pat. No. 5,385,015, issued to Clements et al., and assigned to United Technologies Corporation, the assignee common to this application, discloses an augmentor design wherein fuel is distributed from a series of vanes circumferentially disposed around a center nose cone. The vanes include a plurality of fuel distribution apertures positioned on both sides of a line of high pressure air apertures. The fuel distribution apertures provide fuel distribution and the line of high pressure air apertures collectively provide pneumatic bluff bodies analogous to prior art mechanical flame holders. An advantage of this design is that the elimination of the spray rings and flame holders in the core gas path avoids the temperature/material problem and helps minimize pressure drops within the augmentor. A difficulty with this design is that the spacing between vanes at the outermost radial positions makes it more difficult to achieve a uniform circumferential distribution of fuel at the outermost radial positions. This is particularly true when the augmentor is deployed in a high altitude, low velocity situation.

For a better understanding, it is necessary to appreciate the environment in which hi-performance gas turbine engines operate. Aircraft utilizing hi-performance gas turbine engines typically operate in a flight envelope that encompasses a wide variety of atmospheric conditions. At sea level, one or more fuel pumps provide the maximum flow rate of fuel to the engine through fixed piping and orifices at the maximum amount of pressure. At higher altitudes, a lower fuel flow rate is required, but the geometries of the fuel piping and orifices do not change. As a result, the pressure of the fuel exiting the constant area orifices is reduced. Reducing the pressure of the fuel exiting the fuel distribution apertures, decreases the distance that the fuel will travel circumferentially within the augmentor, into the core gas flow path.

What is needed, therefore, is a method and apparatus for distributing fuel in an augmentor that is tolerant of higher temperatures, that causes minimal pressure drop within the augmentor, and that uniformly distributes fuel circumferentially within the augmentor under a variety of environmental conditions.

DISCLOSURE OF THE INVENTION

It is an object of the present invention, therefore, to provide a method and an apparatus for distributing fuel within an augmentor that is tolerant of higher temperatures.

It is another object of the present invention to provide a method and an apparatus for distributing fuel within an augmentor that causes minimal pressure drop within the augmentor.

It is still another object of the present invention to provide a method and an apparatus for distributing fuel within an augmentor that uniformly distributes fuel circumferentially under a variety of environmental conditions.

According to the present invention, a method for distributing fuel within a gas turbine engine is provided comprising the following steps:

(1) Providing an augmentor, positioned aft of the fan, compressor, and turbine of the engine. The augmentor includes a nose cone centered on the rotational centerline of the engine and a case having an inner lining and an outer wall substantially concentric with the nose cone. The compressor, turbine, and augmentor define a path for core gas flow through the engine.

(2) Providing a plurality of vanes, circumferentially distributed within the augmentor, each of which includes a pair of side walls and an aft wall, and a plurality of fuel apertures and pressurized gas apertures extending through the side walls. At least one of the pressurized gas apertures is positioned adjacent and forward of all fuel apertures at a particular position.

(3) Providing at least one fuel distributor, disposed in each vane, which includes a plurality of orifices for distributing fuel. Fuel admitted into the fuel distributors flows into the core gas path in a direction substantially perpendicular to the core gas path.

(4) Admitting gas at a pressure higher than that of the core gas flow into the vane. The pressurized gas exits into the core gas path through the pressurized gas apertures, flowing a distance into the core gas path in a direction substantially perpendicular to the core gas path.

(5) Selectively admitting fuel into the fuel distributors when the augmentor is enabled. Pressurized gas entering the core gas path forward of the fuel creates a low velocity wake that enables the fuel to distribute circumferentially.

According to an aspect of the present invention, an augmentor for a gas turbine engine is provided.

According to another aspect of the present invention, an apparatus for distributing fuel within a gas turbine engine augmentor is provided.

An advantage of the present invention is that the method and apparatus for distributing fuel within an augmentor for a gas turbine engine is tolerant of higher temperatures. Specifically, the fuel distribution means and flame holder means that were disposed in the core gas flow previously, are now enclosed in vanes and cooled therein. Hence, the temperature limitations of the fuel distribution means and flame holder means are significantly higher.

A further advantage of the present invention is that the method and apparatus for distributing fuel causes minimal pressure losses within the augmentor. In the present invention, the fuel distribution means and flame holder means are disposed in an aerodynamically shaped vane, rather than directly in the core gas flow path. The circumferentially distributed vanes minimize the pressure drop within the augmentor.

A still further advantage of the present invention is that the method and apparatus for distributing fuel uniformly distributes fuel circumferentially within the augmentor under a variety of environmental conditions. In particular, the present invention improves the circumferential distribution of fuel within the augmentor at points within the flight envelope where aircraft are traveling at higher altitudes at relatively low speeds. A person of skill in the art will recognize that improving augmentor performance in these regions is quite desirable.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 shows a diagrammatic sectional view of a gas turbine engine.

FIG. 2 shows a diagrammatic view of an augmentor, shown from the rear of the engine.

FIG. 3 shows an enlarged sectional view of an augmentor.

FIG. 4 shows a sectional view of the vane shown in FIG. 3.

BEST MODE FOR CARRYING OUT THE INVENTION

Referring to FIG. 1, a gas turbine engine 10 may be described as comprising a fan 11, a compressor 12, a combustor 14, a turbine 16, and an augmentor 18. Air entering the fan 11 is divided between core gas flow 20 and bypass air flow 22. Core gas flow 20 follows a path initially passing through the compressor 12 and subsequently through the combustor 14 and turbine 16. Finally, the core gas flow 20 passes through the augmentor 18 where fuel 19 (see FIG. 4) is selectively added, mixed with the flow 20 and burned to impart more energy to the flow 20 and consequently more thrust exiting the nozzle 24 of the engine 10. Hence, core gas flow 20 may be described as following a path essentially parallel to the axis 26 of the engine 10, through the compressor 12, combustor 14, turbine 16, and augmentor 18. Bypass air 22 also follows a path parallel to the axis 26 of the engine 10, passing through an annulus 28 along the periphery of the engine 10.

FIG. 2 shows a diagrammatic view of the augmentor 18 identified in FIG. 1, as viewed from the rear of the engine 10. The augmentor 18 includes a nose cone 30, a case 32 having an inner lining 34 and an outer wall 36, and a plurality of circumferentially disposed vanes 38 extending radially outward from the nose cone 30 to the inner lining 34.

Now referring to FIGS. 3 and 4, a vane 38 includes a pair of side walls 40 and an aft wall 42, and a plurality of fuel apertures 44 and pressurized gas apertures 46 extending through the side walls 40. The side walls 40 and the aft walls 42 define an interior region 48. The aft wall 42 is disposed substantially perpendicular to the side walls 40.

The fuel apertures 44 within the vanes 38 are disposed in a pattern extending from the nose cone 30 to the inner lining 34. At a particular position on the vane 38, core gas flow 20 will pass by at least one of the fuel apertures 44 within the pattern. In some instances, fuel apertures 44 within the pattern may be disposed such that core gas flow 20 passing a first fuel aperture 44 will pass by one or more aligned fuel apertures 44 disposed aft of the first fuel aperture 44. At some or all of the positions on the vane 38 where a fuel aperture 44 is located, a pressurized gas aperture 46 will be located forward of all the fuel apertures 44 at that position. As a result, core gas flow 20 passing by that particular pressurized gas aperture 46 will also pass by the fuel aperture(s) 44 located aft of the pressurized gas aperture 46, unless an obstruction is placed forward of the fuel aperture (s) 44. The aforementioned fuel and pressurized gas aperture 44,46 arrangement may be described as an assisted fuel distribution port. In each port, a pressurized gas aperture 46 and at least one fuel aperture 44 are provided, and the pressurized gas aperture 46 is positioned adjacent and forward of the fuel distribution apertures 44 in the port.

One or more fuel distributors 50, each having a head 52 and a body 54, are disposed in the interior region 48 of each vane 38. The head 52 of each fuel distributor 50 is attached to the outside surface 56 of the outer wall 36 of the case 32. Fuel feed lines 58 extending from a fuel source (not shown) couple with the head 52. One end of the body 54 is fixed to the head 52 and the other end is received within the nose cone 30. A plurality of fuel orifices 60 in the body 54 are positioned in a pattern along the length of the body 54. The pattern of fuel orifices 60 within the body 54 of each fuel distributor 50 matches the pattern of the fuel apertures 44 in the vane 38 in which the fuel distributor 50 will be mounted.

In the operation of the engine 10 (see FIG. 1), bypass air 22 entering the vanes 38 continuously exits the interior region 48 of the vanes 38 through the pressurized gas apertures 46 positioned in the side walls 40 of the vanes 38, regardless of the state of the augmentor 18. The bypass air 22 "jets" exiting the vane 38 travel a distance into the core gas flow 20 path in a direction substantially perpendicular to the direction of the path (see FIG. 4). The bypass air 22 jets create low velocity wakes in the area adjacent the fuel apertures 44. The low velocity wakes may be defined as pockets within the core gas flow 20 path around which a percentage of the core gas flow 20 has been diverted, leaving a pocket of quiescence relative to the normal flow within the core gas flow 20 path.

When the augmentor 18 is actuated, fuel 19 (see FIG. 4) is admitted into the fuel distributors 50 within the vanes 38. The fuel 19 exits the orifices 60 and the fuel apertures 44 and extends out a distance into the low velocity wakes formed in the core gas flow 20 path, in a direction substantially perpendicular to the direction of the path. The low velocity wakes "shield" the fuel exiting the fuel apertures 44 and thereby enable the fuel 19 to travel circumferentially further than it would have been able to otherwise.

After circumferentially distributing, the fuel 19 mixes with the core gas flow 20 and the bypass air 22 introduced in the core gas flow 20 and proceeds downstream. The aft walls 42 of the vanes 38 create low velocity wakes within the core gas flow 20 in the region beyond the vanes 38. The low velocity wakes provide a region for stabilizing and propagating flame.

Although this invention has been shown and described with respect to the detailed embodiments thereof, it will be understood by those skilled in the art that various changes in form and detail thereof may be made without departing from the spirit and scope of the claimed invention.

We claim:

1. A method for distributing fuel within a gas turbine engine, wherein the engine includes a forward end, an aft end, a fan, a compressor, a turbine, and a rotational centerline, comprising the steps of:

providing an augmentor, positioned aft of the fan, compressor, and turbine, said augmentor including a nose cone centered on the rotational centerline of the engine and a case having an inner lining substantially concentric with said nose cone, wherein said compressor, turbine, and augmentor define a path for core gas flow through the engine;

providing a plurality of vanes, circumferentially distributed within said augmentor and extending lengthwise, radially outward from said nose cone to said inner lining, each of said vanes including a pair of side walls and an aft wall which define an interior region, a plurality of fuel apertures and pressurized gas apertures extending through said side walls, wherein at least one of said pressurized gas apertures is positioned adjacent and forward of all said fuel apertures at a particular position;

providing at least one fuel distributor, disposed in said interior region of each vane, which extends lengthwise between said nose cone and said inner lining, said fuel distributor having a plurality of orifices for distributing fuel, said orifices aligned with said fuel apertures such that fuel admitted into said fuel distributors flows through said orifices and fuel apertures and into said core gas path in a direction substantially perpendicular to said path of said core gas flow;

admitting gas at a pressure higher than that of said core gas flow into said vane interior regions, wherein said pressurized gas enters said interior regions and exits into said core gas flow through said pressurized gas apertures, traveling a distance into said core gas flow in a direction substantially perpendicular to said path of said core gas flow;

selectively admiring fuel into said fuel distributors when said augmentor is enabled;

wherein said pressurized gas entering said core gas flow forward of said fuel apertures creates a low velocity wake that enables fuel exiting said fuel apertures to distribute circumferentially.

2. A method according to claim 1, wherein said aft wall of each of said vanes is disposed such that a low velocity wake is created immediately aft of said vane as said core gas flow passes thereby.

3. A method according to claim 1, wherein said aft wall of each of said vanes is disposed such that a low velocity wake is created immediately aft of said vane as said core gas flow passes thereby.

4. A method for distributing fuel within a gas turbine engine, wherein the engine includes a forward end, an aft end, a fan, a compressor, a turbine, and a rotational centerline, comprising the steps of:

providing an augmentor, positioned aft of the fan, compressor, and turbine, said augmentor including a nose cone centered on the rotational centerline of the engine and a case having an inner lining substantially concentric with said nose cone, wherein said fan, compressor, turbine, and augmentor define a path for core gas flow through the engine;

providing a plurality of vanes, distributed circumferentially within said augmentor, each said vane extending radially outward from said nose cone to said inner lining, wherein each of said vanes includes:

a pair of side walls and an aft wall which define an interior region;

a fuel distributor, having a plurality of orifices, disposed in said interior of each said vane;

a plurality of fuel apertures, extending through said side walls, aligned with said fuel distributor orifices, wherein fuel admitted into said fuel distributors flows through said orifices and said fuel apertures and into said core gas flow in a direction substantially perpendicular to said path of said core gas flow;

at least one pressurized gas aperture, extending through said vane side wall, wherein pressurized gas admitted into said interior region of said vane flows through said pressurized gas apertures and into the core gas flow, in a direction substantially perpendicular to said path of said core gas flow;

providing at least one assisted fuel distribution port per vane, said port including said pressurized gas aperture and at least one fuel aperture, wherein said pressurized gas aperture is positioned adjacent and forward of said fuel aperture in said port;

selectively admitting fuel into said fuel distributors when said augmentor is enabled;

wherein said pressurized gas entering said core gas flow forward of said fuel apertures creates a low velocity wake that enables fuel exiting said fuel apertures to distribute circumferentially.

5. A method according to claim 4, wherein said aft wall of each of said vanes is disposed such that a low velocity wake is created immediately aft of said vane as said core gas flow passes thereby.

6. A method according to claim 5, wherein said source of pressurized gas includes gas pressurized by the fan and separated from said core gas flow.

7. An augmentor for a gas turbine engine, wherein the engine includes a forward end, an aft end, a rotational centerline, and a core gas flow passing through the engine along a path from the forward end to the aft end, comprising:

a nose cone, centered on the rotational centerline of the engine;

a case, having an inner lining substantially concentric with said nose cone;

a plurality of vanes, circumferentially distributed within said augmentor and extending lengthwise, radially outward from said nose cone to said inner lining, each of said vanes including a pair of side walls and an aft wall which define an interior region, a plurality of fuel apertures and pressurized gas apertures extending through said vane side walls, wherein at least one of said pressurized gas apertures is positioned adjacent and forward of all said fuel apertures at a particular position; and wherein pressurized gas admitted into said interior region of said vane flows through said pressurized gas apertures and into the core gas flow, in a direction substantially perpendicular to the path of the core gas flow;

at least one fuel distributor, disposed in said interior region of each said vane, extending lengthwise between said nose cone and said inner lining, said fuel distributor having a plurality of orifices for distributing fuel, wherein said orifices align with said fuel apertures such that fuel admitted into said fuel distributors flows through said orifices and fuel apertures and into the core gas flow in a direction substantially perpendicular to the path of the core gas flow; and wherein said pressurized gas entering the core gas flow forward of said fuel apertures creates a low velocity wake that enables fuel exiting said fuel apertures to distribute circumferentially.

8. An augmentor according to claim 7, wherein said aft wall of each of said vanes is disposed such that a low velocity wake is created immediately aft of said vane as said core gas flow passes thereby.

9. An augmentor according to claim 8, wherein said source of pressurized gas is bypass air created by a forwardly disposed fan and separated from said core gas flow.

10. An apparatus for distributing fuel within a gas turbine engine augmentor, wherein the augmentor includes a nose cone centered on the rotational centerline of the engine, and a case, having an inner lining substantially concentric with the nose cone, comprising:

a plurality of vanes, circumferentially distributed within said augmentor and extending lengthwise, radially outward from the nose cone to the inner lining, each of said vanes including a pair of side walls and an aft wall which define an interior region, and a plurality of fuel apertures and pressurized gas apertures extending through said vane side walls, wherein at least one of said pressurized gas apertures is positioned adjacent and forward of all said fuel apertures at a particular position;

wherein pressurized gas admitted into said interior region of said vane flows through said pressurized gas apertures and into core gas flow passing by said vane, in a direction substantially perpendicular to said core gas flow;

at least one fuel distributor, disposed in said interior region of each said vane, extending lengthwise between said nose cone and said inner lining said fuel distributor having a plurality of orifices for distributing fuel, wherein said orifices align with said fuel apertures, such that fuel admitted into said fuel distributors flows through said orifices and fuel apertures and into said core gas flow in a direction substantially perpendicular to said core gas flow; and wherein said pressurized gas entering said core gas flow forward of said fuel apertures creates a low velocity wake that enables fuel exiting said fuel apertures to distribute circumferentially.

11. An apparatus for distributing fuel according to claim 10, wherein said aft wall of each of said vanes is disposed such that a low velocity wake is created immediately aft of said vane as said core gas flow passes thereby.

12. A gas turbine engine, comprising:

a fan, disposed at a forward end or said engine;

a compressor, disposed aft of said fan, wherein said fan and said compressor add work to a core gas flow passing through said engine along a path from said forward end to an aft end;

a turbine, disposed aft of said compressor, wherein said core gas flow passing through said engine drives said turbine, and said turbine drives said fan and compressor, and an augmentor, disposed at said aft end of said engine, said augmentor including:

a nose cone, centered on a rotational centerline of said engine;

a case, having an inner lining substantially concentric with said nose cone;

a plurality of vanes, circumferentially distributed within said augmentor and extending lengthwise, radially outward from said nose cone to said inner lining each of said vanes including a pair of side walls and an aft wall which define an interior region, a plurality of fuel apertures and pressurized gas apertures extending through said vane side walls, wherein at least one of said pressurized gas apertures is positioned adjacent and forward of all said fuel apertures at a particular position; and wherein pressurized gas admitted into said interior region of said vane flows through said pressurized gas apertures and into said core gas flow, in a direction substantially perpendicular to said path of said core gas flow;

at least one fuel distributor, disposed in said interior region of each said vane, extending lengthwise between said nose cone and said inner lining said fuel distributor having a plurality of orifices for distributing fuel, wherein said orifices align with said fuel apertures such that fuel admitted into said fuel distributors flows through said orifices and fuel apertures and into said core gas flow in a direction substantially perpendicular to said path of said core gas flow; and wherein said pressurized gas entering said core gas flow forward of said fuel apertures creates a low velocity wake that enables fuel exiting said fuel apertures to distribute circumferentially.

13. A gas turbine engine according to claim 12, wherein said aft wall of each of said vanes is disposed such that a low velocity wake is created immediately aft of said vane as said core gas flow passes thereby.

14. A gas turbine engine according to claim 13, wherein said source of pressurized air is bypass air created by a forwardly disposed fan and separated from said core gas flow.

15. An apparatus for distributing fuel within a gas turbine engine augmentor, wherein the augmentor includes a nose cone centered on the rotational centerline of the engine, and a case having an inner lining substantially concentric with the nose cone, comprising:

a plurality of vanes, circumferentially distributed within said augmentor and extending radially between the nose cone and the inner lining, each of said vanes including a pair of side walls and an aft wall which define an interior region, and a plurality of fuel apertures and pressurized gas apertures extending through said vane side walls, wherein at least one of said pressurized gas apertures is positioned adjacent to, and aligned upstream of all said fuel apertures at a particular position;

at least one fuel distributor, disposed in said interior region of each said vane, extending radially between said nose cone and said inner lining, said fuel distributor having a plurality of orifices for distributing fuel, wherein said orifices align with said fuel apertures, and fuel admitted into said fuel distributors jets through said orifices and fuel apertures and into said core gas flow in a direction substantially perpendicular to said core gas flow; and wherein pressurized gas exiting said pressurized gas apertures upstream of; and aligned with, said fuel apertures jets circumferentially outward from said vane, into said core gas flow, creating a low velocity wake upstream of said fuel apertures that enables fuel jetting from said fuel apertures to distribute circumferentially.

16. An apparatus for distributing fuel according to claim 15, wherein said aft wall of each of said vanes is disposed such that a low velocity wake is created immediately aft of said vane as said core gas flow passes thereby.

* * * * *